United States Patent [19]

Meylan

[11] Patent Number: 4,457,658

[45] Date of Patent: Jul. 3, 1984

[54] DEVICE FOR INTRODUCING A BATCH OF SHEETS INTO A PROCESSING MACHINE

[75] Inventor: Georges Meylan, Preverenges, Switzerland

[73] Assignee: Bobst SA, Switzerland

[21] Appl. No.: 345,149

[22] Filed: Feb. 2, 1982

[30] Foreign Application Priority Data

Feb. 3, 1981 [CH] Switzerland ..... 718/81

[51] Int. Cl.[3] ..... B65G 59/02

[52] U.S. Cl. ..... 414/114; 414/119

[58] Field of Search ..... 414/114, 117, 118, 119, 414/120

[56] References Cited

U.S. PATENT DOCUMENTS

| | | | |
|---|---|---|---|
| 3,608,747 | 9/1971 | Shibata et al. | 414/114 |
| 3,687,303 | 8/1972 | Kramer et al. | 414/114 |
| 3,966,059 | 6/1976 | Sase | 414/114 |
| 3,982,750 | 9/1976 | Pulda | 271/151 |
| 4,119,221 | 10/1978 | Hazard | 414/114 |

FOREIGN PATENT DOCUMENTS

| | | | |
|---|---|---|---|
| 2313294 | 12/1976 | France | 414/114 |

*Primary Examiner*—Robert J. Spar
*Assistant Examiner*—Ken Muncy
*Attorney, Agent, or Firm*—Hill, Van Santen, Steadman & Simpson

[57] ABSTRACT

A device for separating a batch of sheets from a pile of sheets and introducing the batch into a conveyor of a machine designed for processing the sheets characterized by a frame having a movable stop member mounted thereon, a unit for moving a pile of sheets so that the end of the pile is adjacent the movable stop, a unit which cooperates with the movable stop and separates a batch of sheets from the one end of the pile and another unit for moving the separated batch of sheets in a second direction parallel to the plane of the sheets in the pile to pass through an opening provided by moving the movable stop to enable introduction of the batch into a conveyor of a machine.

10 Claims, 10 Drawing Figures

DEVICE FOR INTRODUCING A BATCH OF SHEETS INTO A PROCESSING MACHINE

BACKGROUND OF THE INVENTION

The present invention is directed to a device for separating a batch of sheets from a pile of sheets and then introducing the batch into a conveyor of a machine which is designed for processing the sheets.

The feeding of large size pasteboard or boxboard sheets into a machine used for printing and cutting the sheets is generally achieved in an automatic fashion in order to avoid toilsome work for the staff employed for the operation. One solution for automatically feeding the sheets into a processing machine consists in moving a pile of sheets from a vertical orientation into a horizontal position by means of an appropriate conveyor and device. When the pile is in the horizontal position, the sheets are then moved from the pile in such a manner that they will form a stream of shingled or scale-like wise arranged sheets which stream is then carried as far as the feeding station of the processing machine. After introduction into the station, the sheets of the stream are piled up again in order to be in a position which is compatible with the feeding system used by the processing machine. A device for accomplishing this is disclosed in U.S. Pat. No. 3,982,750. Because the sheets which are supplied to a board converter will have dimensions such as a width of between 1600 and 2000 mm and a length of between 1100 and 1270 mm and are received in a palletized pile with a height of approximately 1600 to 1700 mm, the pile, which is being handled by the apparatus, will have an extremely heavy weight when the palletized pile is fed to the machine.

While the above mentioned patent will enable relatively easily handling of the pile of sheets, the device does have the drawback of being a very large device which requires the use of various jointed conveyors which are extensive and also requires a more complex set up. In addition to this, it is extremely inefficient to change a pile into a stream of sheets and before applying any new working steps to the streams of sheets converting the stream back into a pile as proposed in the above solution.

SUMMARY OF THE INVENTION

The present invention is directed to providing a device which will enable feeding large size sheets into a processing machine, which device is more efficient and less clumsy than existing devices.

To achieve this task, the device which separates a batch of sheets from a pile of sheets and introduces the batch of sheets into a conveyor of the machine comprises a frame having a movable stop member mounted thereon; means for moving the stop member to a position to create a discharge opening; means for moving a pile of sheets in one direction perpendicular to the plane of the sheets with one end of the pile being adjacent said movable stop; means cooperating with the movable stop for separating a batch of sheets from said one end of the pile; and means for moving said batch of sheets in a second direction parallel to the plane of the sheets in a pile through the opening for introduction into a conveyor of the machine.

The means for moving a pile of sheets preferably is a lifting or elevator device and includes means for regulating the position of the one end of the pile relative to the stop member so that the size of the batch being removed from the pile can be controlled. The means for separating the batch of sheets includes a separating member, a pair of movable pile pressing members which are disposed on each side of the separating member and means for moving the separating member and pressing member with the separating member being moved towards the movable stop and against the edges of the sheets disposed therebetween to cause a separating and lifting up of the batch of sheets from the pile with the pile pressing members being inserted between the lifted batch and the remaining portion of the pile.

Preferably, the pile pressing members are mounted on the sides of a cradle which has a pair of equal length lever arms which are pivotably mounted in the cradle and pivotably connected to the separating member to form a parallelogram linkage which can move from a rest position of approximately 15 to 30 degrees to the second direction to an elevated position which is determined by an adjustable stop as the cradle is moved in the frame. The adjustable stop can be connected to control means which will limit the motion of the cradle. The pile pressing members are preferably mounted for rotation about pivot points on the cradle and have cam followers which engage linear cams which are on the frame of the device. Preferably, the cradle is mounted for movement in a sub-frame or chasis of the frame which sub-frame is adjustable in relation to the main frame and also supports the batch pushers and a drive mechanism for the batch pushers which form the means for moving the batch of sheets in the second direction. Each of the batch pushers are pivotably mounted on a carriage which is moved along the second direction by a chain drive system. Each of the pushers has a safety means, such as a roller, which prevents jamming due to a misshapen sheet in the pile.

DESCRIPTION OF THE PREFERRED EMBODIMENTS

Figure 1:
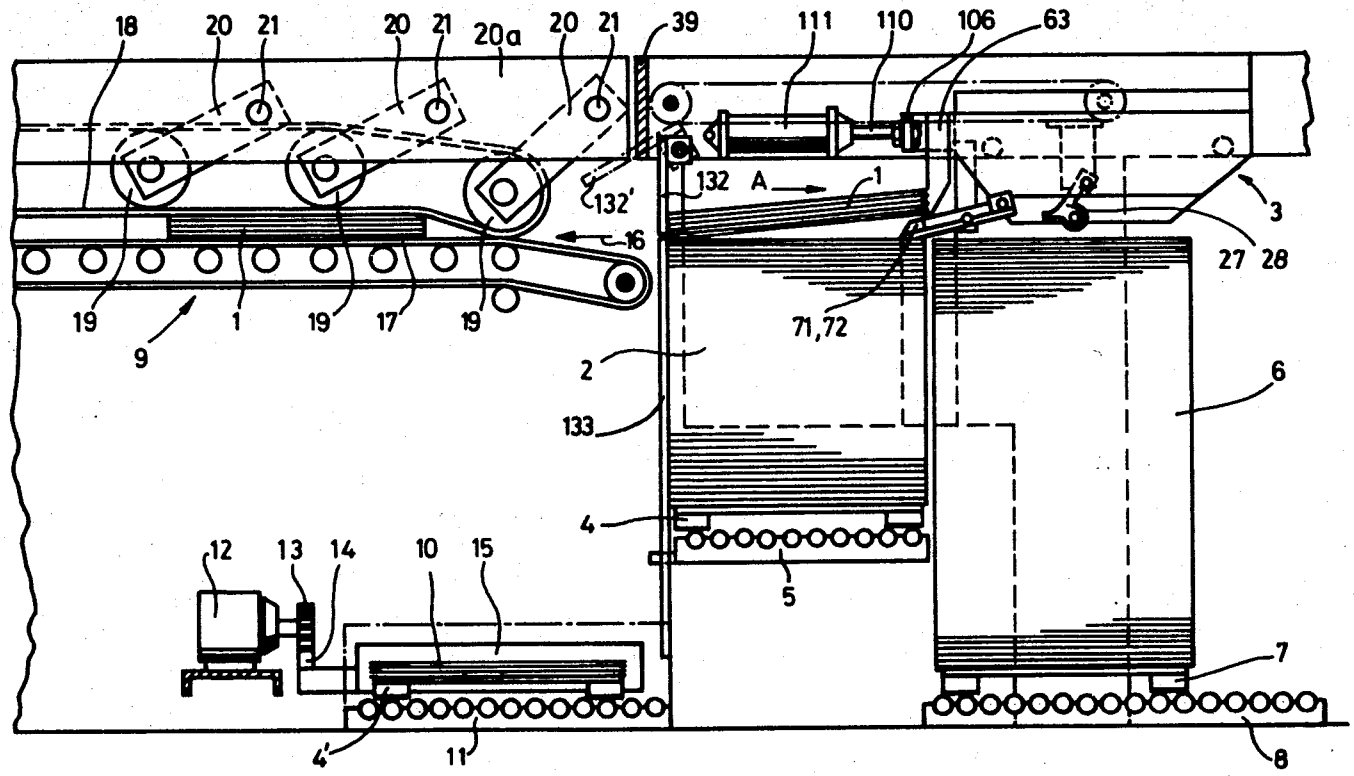
FIG. 1 is a side view with portions broken away for purposes of illustration of a device in accordance with the present invention arranged with the entrance end of a machine for processing a batch that is separated from a pile of sheets.

The principles of the present invention are particularly useful in a device generally indicated at 3 in FIG. 1. The device 3 separates a batch 1 of sheets from a pile 2 of sheets resting on a pallet 4 and then introduces the separated batch 1 to a conveyor system generally indicated at 9 which will transfer the batch to a sheet processing machine or apparatus which is not illustrated.

The device 3 has a frame composed of members such as frame members 39 and has a stationary or fixed stop 133 with a movable stop 132 aligned therewith. The device 3 includes means for moving the pile such as a pile-hoisting device 5 which is operated by a chain drive system and moves the pile 2 along the fixed stop 133 until one end of a pile which is the top is in a position adjacent the movable stop 132. As illustrated, another pile of sheets is resting on a pallet 7 which is in a standby position on a roller conveyor 8 and ready to be shifted onto the pile-hoisting device 5 as soon as the pile 2 on the pallet 4 has been fed in batches into the conveyor 9 and has been removed. The loading of the new pile 6 is achieved in the following manner. After feeding of the last batch from the pile 2 into the conveyor 9, the pallet 4, which still supports some sheets 10 as might happen in certain instances, is moved to the lowermost position so that it can be shifted to a position of pallet 4' on a roller conveyor 11. A pile 6 is then moved onto the pile hoisting appliance or device 5 with another new pile not shown being moved into the position being previously occupied by the pile 6. After the remains of the pile on the conveyor 5 had been moved to the position of the pallet 4', a motor 12 is started up and drives a pinion 13 that engages a rack 14 which is connected to a flap or bar 15, which will ensure removal of the pallet 4' perpendicular to the running direction indicated by an arrow 16 for the conveyor 9. The sheets 10 which are resting on the pallet such as 4' will then be put manually into a pile not shown which is waiting to be processed.

The conveyor 9 includes a lower transportation belt 17, which moves in a fixed direction. At an appropriate distance above the lower belt 17, there is an upper belt 18 which is carried by pulleys 19, which are rotatably mounted on levers 20 that are mounted on the upper frame 20*a* by an axle 21. Due to the weight of the pulleys 19, the upper belt 18 will be pressed onto the batches 1 of sheets. The conveyor 9, as illustrated, engages the center of the batches and the edges of the batches 1 will rest on a table or a supporting guides which are not illustrated.

Figure 5:
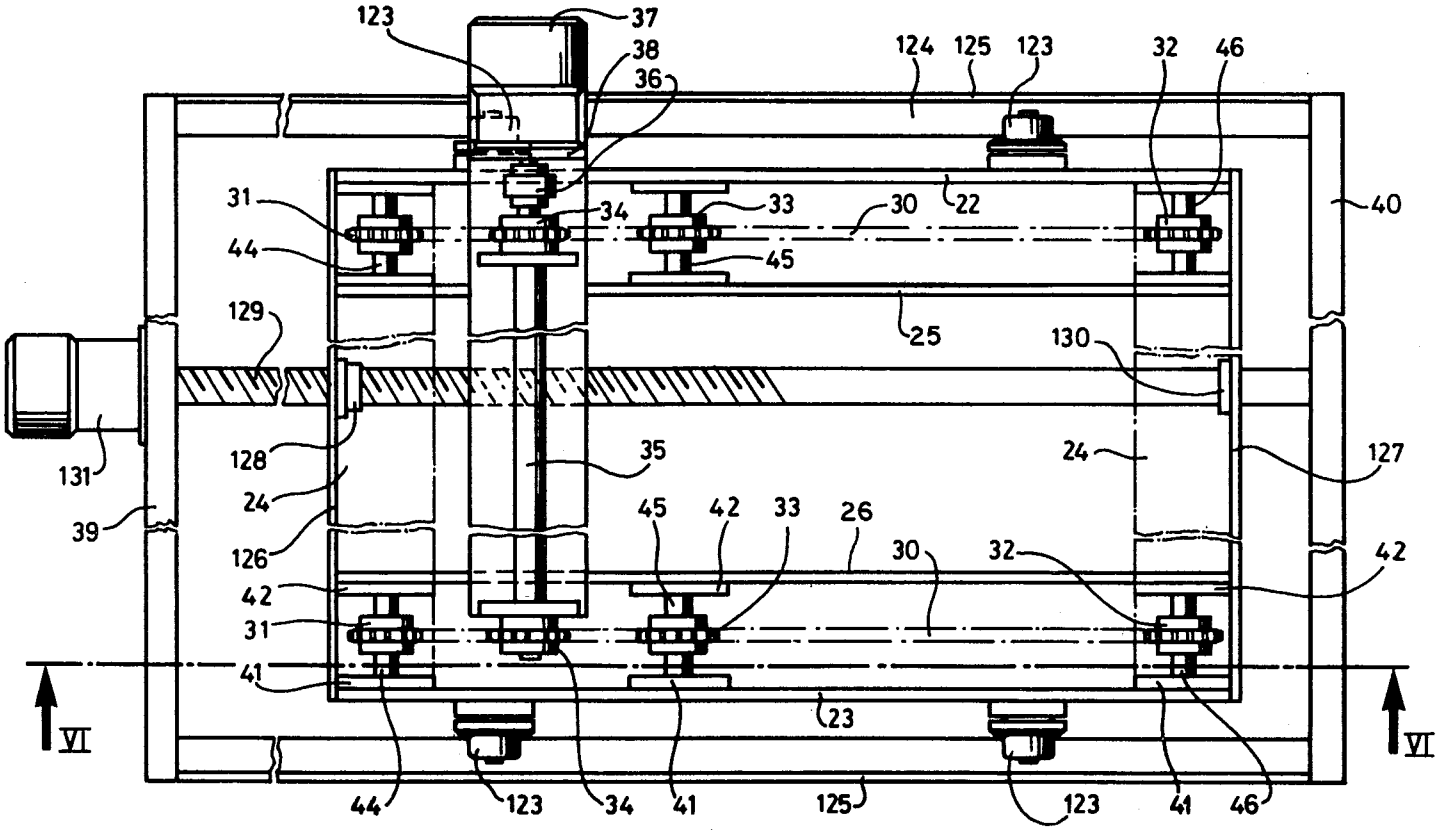
FIG. 5 is a plan view of the device of FIG. 1.

In addition to the lifting device 5 which forms means for moving the pile 2 to a point with one end adjacent the movable stop 132, the device 3 includes means for separating a batch 1 from the pile 2 and means for moving or shifting the separated batch through an opening which is created by the movable stop 132 being moved to a position 132' into the conveyor 9. The means for shifting the batch includes a sub-frame or chasis with two outer side guides or frame members 22, 23 which are connected to one another by means of cross bars 24 and end members 126 and 127 (FIG. 5). In addition, the end members 126 and 127 and as well as the cross bars 24, as best seen in FIG. 5 holds a pair of inner guide members 25 and 26 in the correct position.

Figure 6:
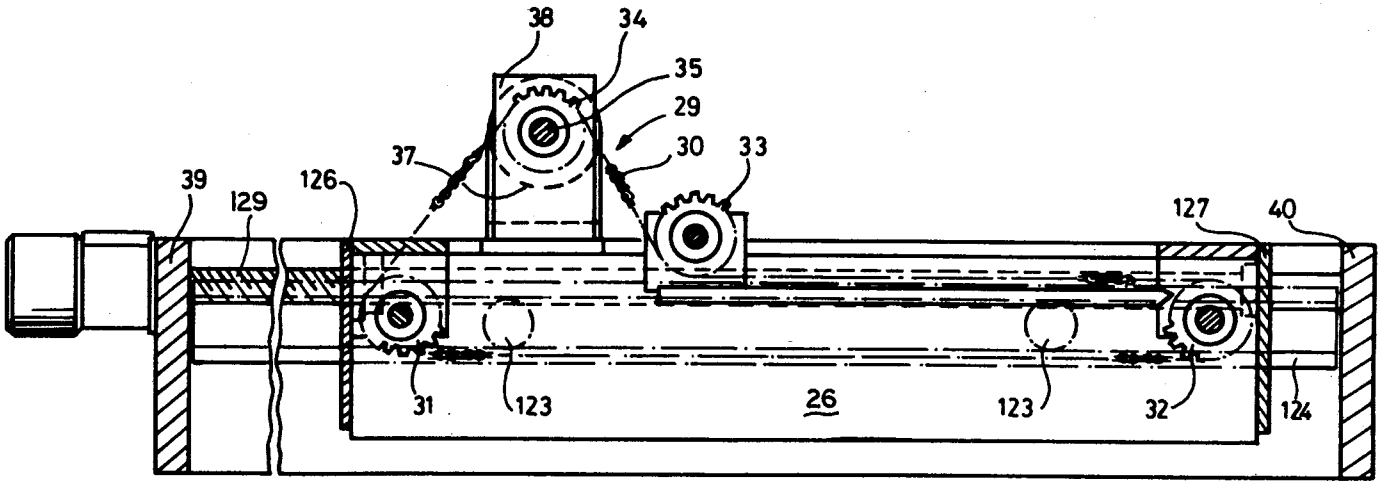
FIG. 6 is a cross-sectional view taken along the lines VI—VI of FIG. 5.

As illustrated, the inner guide member 25 cooperates with the outer guide member 22 and the inner guide member 26 cooperates with the guide 23. At least one batch pusher 27 is supported and positioned between the inner guide member 25 and the outer guide member 22, and at least one batch pusher 28 is positioned between the guide member 23 and 26. Each of the batch pushing members 27 and 28 are connected to a drive device 29 which will move them along the second direction which will be discussed hereinabove. The drive device 29, as best illustrated in FIGS. 5 and 6 for each batch member includes a chain 30 which extends over a front sprocket 31, a rear sprocket 32, an intermediate sprocket 33 and a drive sprocket 34. The drive sprockets 34 for the two batch pushers are interconnected and are both disposed on a drive shaft 35 which at one end has a coupling sleeve 36 which enables forming a connection between the drive shaft 35 and a hydraulic motor 37. The motor 37 is mounted on the sub-frame formed by the guide members 22, 23, 25, 26, the cross bars 24 and the end members 126 and 127 by a support 38. A hydraulic motor 37 has been chosen because it can be controlled to provide both a forward and backward rotation which is required for this drive. As illustrated, each of the sprockets 31 and 32 and 33 are mounted on axles 44, 45 and 46 respectively. These axles are mounted on the respective guides 22, 23 or 26, by support or bearing plates 41 and 42 which are secured by screws 43 (FIG. 2).

Figure 2:
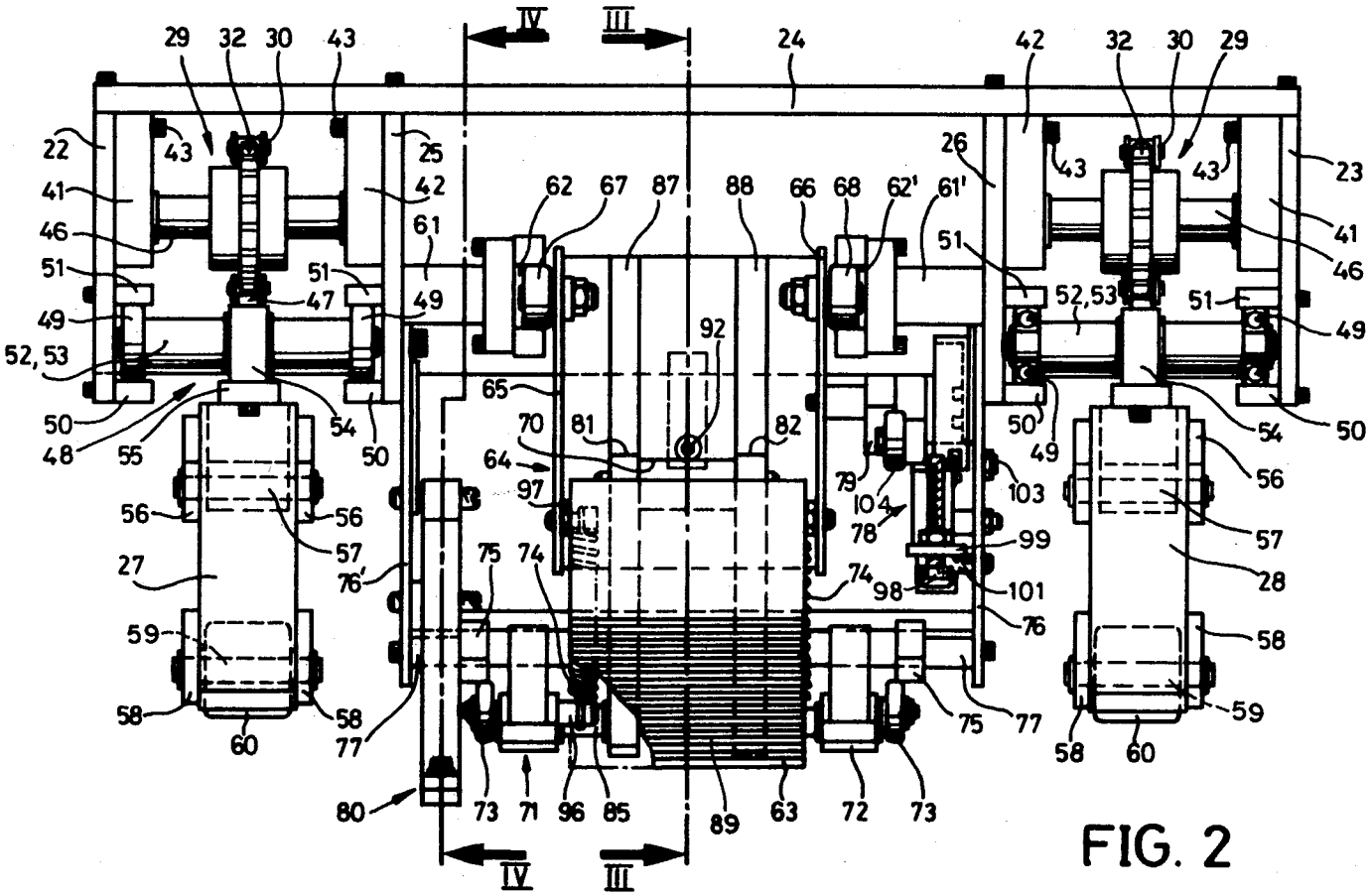
FIG. 2 is an end view generally taken in the direction A of FIG. 1 with portions being removed for purposes of illustration.
Figure 4:
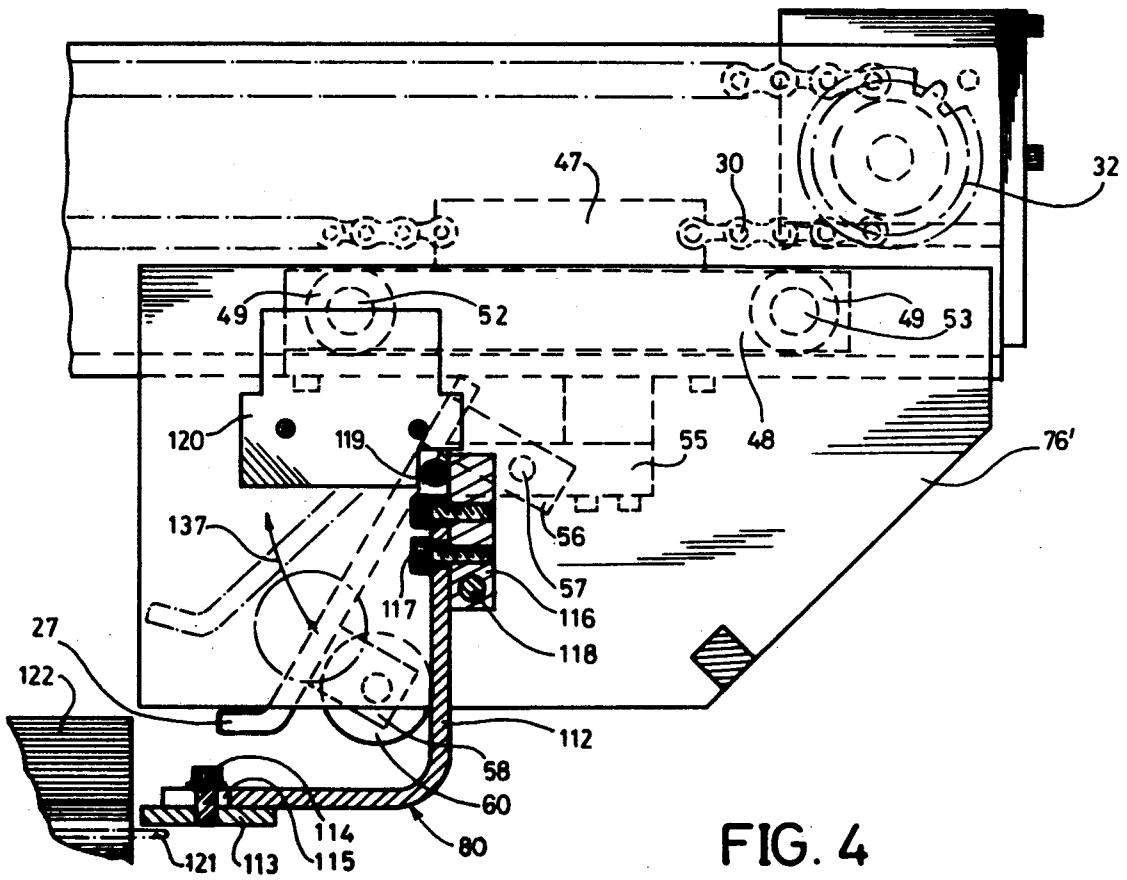
FIG. 4 is a cross-sectional view taken along the lines IV—IV of FIG. 2 with portions removed for purposes of illustration.

The chain 30 is connected with a fixture 47 to a carriage generally indicated 48 in FIG. 2. The carriage has two axles 52 and 53 (FIG. 4) which support a roller formed by an outer race of a ball or roller bearing such as 49 which outer race is received in a track or groove formed by two rails 50 and 51 (FIG. 2) which are attached to the respective guide members such as 22 and 25. Each of the carriages 48 includes a central support 54 containing a portion 55 with a bearing for receiving an axle 57 of the batch pusher 27 or 28. Each of the batch pushers consist of a base member on which two flaps 56 have been welded and which flaps rotatably receive the axle 57. Each batch pusher or member is also provided adjacent the other end with a pair of flaps 58 for holding an axle 59 which supports a roller 60. The roller 60 forms means to prevent jamming which will be discussed hereinafter. The flaps 56 also engage a stop (not illustrated) which prevents pivoting of the pusher 27 from a position such as illustrated in FIG. 4 but allows pivoting or rotation of the pusher 26 on the axle 57 in a direction indicated by the arrow 137. The batch pusher 28 will have the same structure as that mentioned for the pusher 27.

Figure 3:
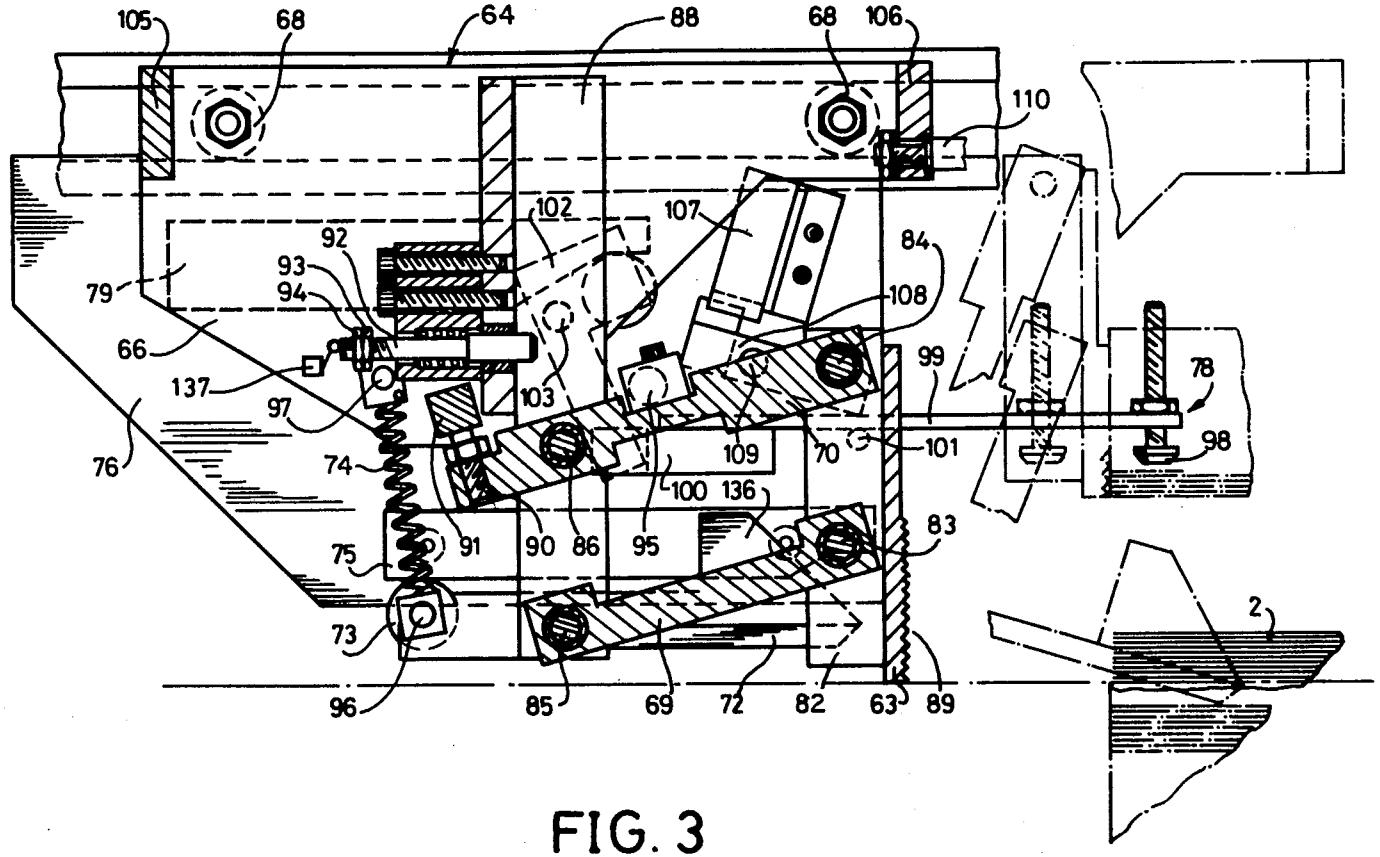
FIG. 3 is a cross-sectional view taken along the lines III—III of FIG. 2.

Each of the guide members 25 and 26 on an inner surface has a support 61, 61' which terminate in members forming guide grooves 62 and 62' respectively. A cradle 64, which has a pair of side walls 65 and 66, which are spaced apart by end members 105 and 106 (FIG. 3) has a pair of rollers 67 on the side wall 65 (FIG. 2) which are received on the guide grooves 62 and a pair of rollers 68 which are mounted on the side walls 66 which are received in the guide groove 62'. It is noted that each of these rollers 67 and 68 utilizes an outer race of a ball bearing or roller bearing as the roller. A separating member or device 63 is positioned between the two walls 65 and 66 of the cradle 64. The separating member 63 is connected to the cradle by a pair of parallel, levers 69 and 70 (See FIG. 3). The members 63 is provided with a pair of wing or bars such as 81 and 82 which contain axles 83 and 84 that pivotably connect the levers 69 and 70 thereto. The other ends of the levers 69 and 70 are connected by axles such as 85 and 86 to bars or members 87 and 88 which are secured to the cradle 64. An outer surface of the separating member 63 is provided with an area 89 having longitudinally extending grooves to improve the holding of sheets in the batch being separated. Due to the equal length of the arms or levers 69 and 70 between the pivotable connections, a parallelogram movement or linkage is produced. The upper bar or lever arm 70 is provided with an adjustable stop 90 that engages a cross member 91 to limit the rotation of the levers in a clockwise direction as illustrated in FIG. 3. As illustrated in FIG. 3, the levers are in their lowermost position, which has the levers or pivot members 69 and 70 extending at an angle in the range of 15–30 degrees to a horizontal. Preferably, the angles are approximately 20 degrees which was adopted for experimental purposes in order to determine the best possible operational move of the separating member 63. The upper position of the member 63 will be indicated when a stop 92, which also can be adjusted by means of nut 93 and a counter nut 94 is engaged by a roller 95, which is secured on the lever 70. The stop 92 is a spring biased stop and will acutate a switch 137 to cause a stopping of the movement of the separating element or member 63.

As best illustrated in FIG. 2, a pair of pile pressing members 71 and 72 are mounted on the outside of the cradle 64. As best illustrated in FIG. 3, this mounting is accomplished by the members being mounted on the axle 85 so that the pressing member 71 and 72 can pivot around the axle. One end of each of the members 71 and 72 is provided with a cam follower formed by a roller bearing 73 (FIG. 2), which will engage a linear cam 75, which is secured by a block member 77 onto a plate 76. One plate 76, which supports the cam 75 for the pressing member 72 is secured to the inner guide member 26 while the other plate member 76' is secured to the other inner guide member 25. The ends of the follower 73 of the respective pressing members 71 and 72 is held by a biasing means such as the spring 74. As best illustrated in FIG. 3, the spring 74 extends between a catch such as 96 on the presser member 72 to a spring attachment 97 which is on an inner surface of the side wall 66 of the cradle 64.

In addition, to supporting the cams such as 75, the one plate member 76 also supports means 78 for checking the height of the pile relative to the movable stop 132. This means 78 will determine or control the size of the batch 1 being removed from the pile. The pile height checking device or means 78 includes an adjustable support 98 (FIG. 3) which is adjustably secured on bar or member 99 which is connected to a bar or member 100. The bar 99 is pressed against a pin 101 at one end of its stroke. The bar 100 is connected to a lever 102, which pivots about an axis 103 and is provided with a cam roller 104 which engages a linear cam 79 which is secured on the side wall 66 of the cradle 64. A magnetic switch 107 is secured on the plate 76 and is actuated when the lever arm 108 (FIG. 3) pivots around an axle 109 and is shifted when the member 99 is raised from the position illustrated in FIG. 3.

To move the cradle 64 along the second direction, a cross bar 106 is secured to a ram 110 of a hyrdraulic piston 111 (FIG. 1). The piston 111 is connected to the sub-frame or chassis.

As best shown in FIGS. 2 and 4, a sheet indicator 80 is secured onto the plate 76'. The sheet position indicator provides means for determining when a sheet's position within the pile is not proper or when a sheet has been misaligned. The indicator 80 consists of a bent blade 112 (FIG. 4) which has a bearing plate 113 secured to its ends. The plate 113 is secured to the bent blade 112 by a screw 114 which is held within a setting slot 115 provided on the end of the blade 112. The other end of the blade 112 is secured to a block 116 by screws 117. The assembly consisting of a blade 112 and the block 116 will pivot about an axis 118. The rest position of the indicator 80 is determined by stop 119. When a sheet such as 121, which is shown in dot and dash lines and protrudes from the edge of the pile 122 to engage the plate 113, the bent blade 112 is then pushed upward by the raising pile 122 and the bent blade 112 will then pivot about the axis 118 with the block 116 actuating a switch 120 to cause stopping of the device.

The main frame of the device 3 is indicated in FIG. 5 by a frame formed by members 39, 40 which are interconnected by lateral or side plates 125. The side plates 125 are provided with track or grooves 124, which receive rollers 123 that are secured to the outer guide 22 and 23 which form a sub-frame as mentioned hereinabove. A front cross bar or end member 126 is provided with a nut 128, which receives a screw 129 whereas the other cross bar 127 is provided with a bearing 130. The screw 129 is actuated by a hydraulic motor 131 which is secured on a frame member 39. The other end of the screw 129 is held by a bearing received in the frame member 40. Depending upon which direction the screw 129 is rotated, the sub-frame will be shifted toward or away from the movable stop 132, which is immediately above a fix stop 133 as illustrated in FIG. 1. This will enable the device to handle the sheets of various dimensions.

Figure 7:
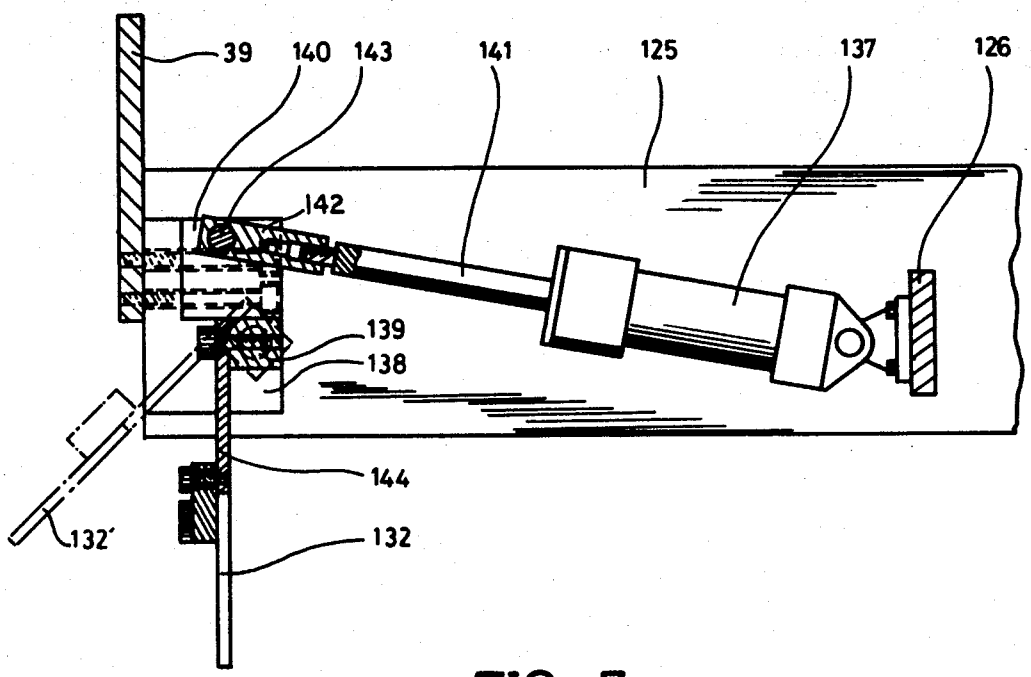
FIG. 7 is an enlarged cross-sectional view with portions in elevation for purposes of illustration of the movable stop member.

As mentioned hereinabove, the frame of the device includes a movable stop 132 which is positioned directly above the stop 133. As best illustrated in FIG. 7, the movable stop is actuated by a hydraulic or pneumatic piston 137 which has one end connected to a crossbar 126 of the sub-frame. A support member 138 is secured onto the cross-bar or frame member 39 of the main frame adjacent to a side plate 125. The support 138 is equipped with a bearing portion 139 for receiving a stud of a lever 140. The hydraulic or pneumatic piston 137 has a piston rod 141 with a rod fitting 142 which is connected by means of an axle 143 with the lever 140. The movable stop 132 is illustrated as being a single blade which is connected to a cross-wise plate 144 which is secured to the lever 140.

Figure 8:
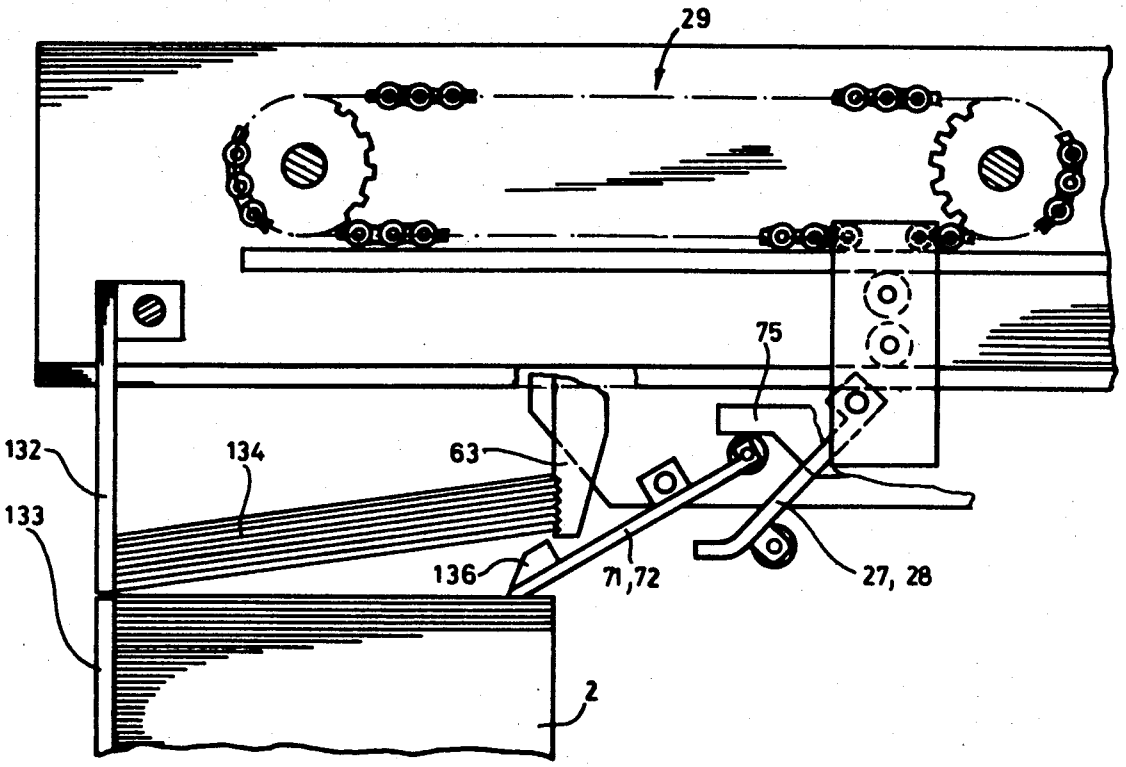
FIGS. 8, 9 and 10 are schematic side views similar to FIG. 1 illustrating the operation of the device during a batch separating and removal operation.

The operation of the device will be described utilizing FIGS. 1, 3, 8, 9 and 10. In a starting position with the separating member such as 63 in its rearmost position such as illustrated in FIG. 3, the pile 2 as may also be seen in FIG. 1 is raised. As soon as the upper surface of the pile 2 contacts the adjustable stop 98 of the means for determining the height 78, the magnetic switch 107 will be acutated by movement of the member 99 to stop further elevation of the pile and the cradle 64 will be shifted by a hydraulic piston 111 until the separating member 63 engages or contacts the edges of the sheets in the pile 2. As the piston 111 continues to draw the cradle toward the movable stop 132, a group of sheets 134 (FIG. 8) will be engaged by the separating member 63 which due to the rotation of the levers 69 and 70 will rise to lift the sheets as the batch 134 as illustrated in FIG. 8. As the cradle continues to move toward the movable stop 132, the pile pressing member 71 and 72 will be inserted between the lifted batch 134 and the top of the remaining portion of the pile and due to the travel of the follower 73 on the linear cam 75 will move to a position such as illustrated in FIG. 8. It is noted that during this operation, the fixed or the movable stop 132 is in the first or lowered position illustrated in FIG. 8.

Figure 9:
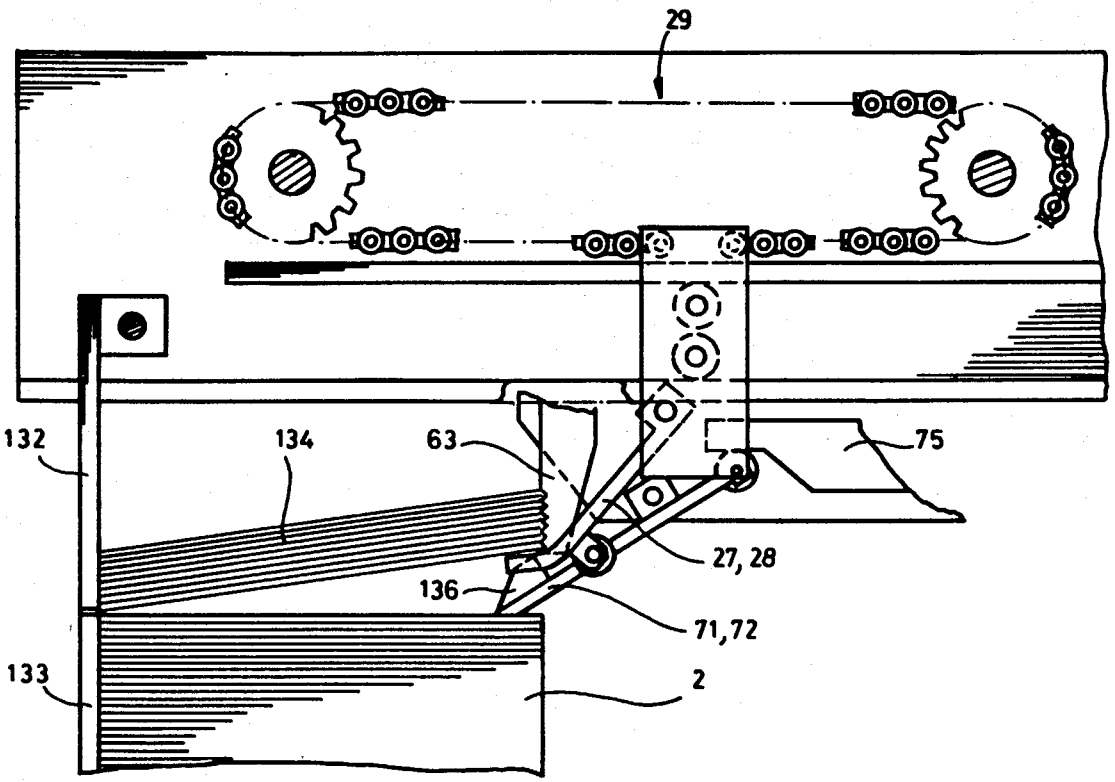
Figure 10:
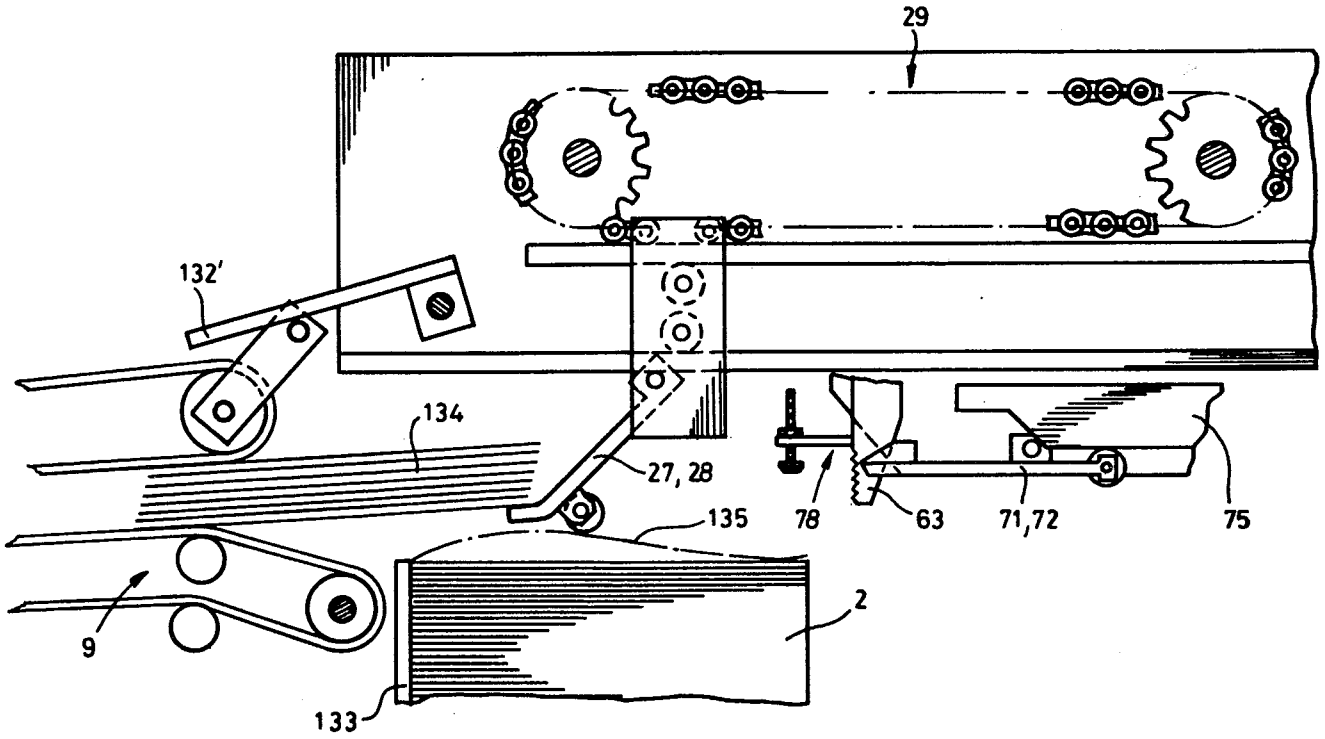

After the pile pressing members 71 and 72 are inserted between the batch 134 and the remaining portion of the pile, the second stage begins with the batch pushers 27 and 28 being shifted by the driving device 29 from the retracted position illustrated in FIG. 8 towards a position with the batch members engaging the lifted edge of the batch 134 (see FIG. 9). As soon as the batch pushers have engaged the edge of the batch 134, the movable stop 132 will be raised to a position 132' (FIGS. 1 and 10) to provide an opening through which the batch may be pushed or moved by the batch pushers 27 and 28 to insert the batch between the belts of the conveyor 9 (FIG. 10). As the batch pushers 27 and 28 contact the rear side or edge of the batch 134, the separating member 63 and the pile pressing member 71 and 72 will be moved backwards by the hydraulic piston which moves the cradle 64.

In addition, it should be noted that as the cradle 64 is moved towards the movable stop 132 during the initiation of the batching process, the movement of the linear cam 79 on the cradle would cause the arm or lever 102 to rotate to move the adjustable stop 98 of the pile height sensing means 78 to a withdrawn position to allow lifting of the batch 132 and its movement from the pile. As the cradle or carriage 64 is withdrawn towards the initial starting position (FIG. 10), the movement of the cam 79 will allow the means 78 to move towards the intitial position illustrated in FIG. 10. In this position, the switch 107 is actuated to initiate a new cycle after the batch pushers 27 and 28 have been retracted to the rearmost position and the movable stop 132 has been moved back towards the stop position as illustrated in FIG. 8.

It should be noted that each of the back pushers 27 and 28 is equipped with the roller 60 so that during the advance of the batch 134 towards the conveyor 9, a warped or badly shaped sheet 135 shown in dot and dash lines in FIG. 10 will not interfere with the movement of the batch pushers. Also, it is noted that each of the pile pressing members 71 and 72 on the free end is provided with an enlarged nose portion 136 to aid in preventing the escape of the sheets in a batch such as 134 and thus preventing them from falling back onto the pile 2 before being engaged by the batch pushers 27 and 28.

Thus, the device 3 enables the easy loading of a batch of large sized sheets on an end feed appliance of a sheet processing machine. Another advantage of the device such as described hereinabove consists in allowing the automatic introduction batches of sheets into a sheet processing machine without the compulsory previous staggering of the sheets in a shingled stream-wise position. This also allows the discarding of an operation likely to impair the loading action in certain circumstances.

Although various minor modifications may be suggested by those versed in the art, it should be understood that we wish to embody within the scope of the patent granted hereon, all such modifications as reasonably and properly come within the scope of our contribution to the art.

I claim:

1. A device for separating a batch of sheets from a pile of sheets and introducing the batch into a conveyor of a machine designed for processing said sheets, the device comprising a frame with a fixed stop having a movable stop member mounted in the frame adjacent the fixed stop; first means for moving the stop member between a first position aligned with the fixed stop to a second position to create a discharge opening between the fixed stop and the movable stop member; second means for moving a pile of sheets in one direction perpendicular to the plane of the sheets with one end of the pile being adjacent said movable stop member; means cooperating with the movable stop member being held by said first means in the first position for separating a batch of sheets from said one end of the pile and third means for moving said batch of sheets in a second direction parallel to the plane of the sheets in the pile through the discharge opening for introduction into a conveyor of the machine.

2. A device according to claim 1, wherein the means for separating the batch of sheets includes a cradle mounted in the frame for movement along the second direction, said cradle having a pair of pile pressing members mounted for pivotable movement thereon, a pair of equal length levers pivotably mounted on the cradle between said pair of pressing members, a separating member pivotably connected to the ends of said pair of levers to form a parallelogram linkage and fourth means for moving the cradle along said second direction so that as the cradle is moved towards the moveable stop member, said separating member engages the edges of a plurality of sheets to move them against the stop member, and then lifts the sheets to form a batch with the pile pressing members being inserted between the batch and the remaining portion of the pile.

3. A device for separating a batch of sheets from a pile of sheets and introducing the batch into a conveyor of a machine designed for processing said sheets, the device comprising a frame with a fixed stop having a movable stop member mounted in the frame adjacent the fixed stop; means for moving the stop member between a first position aligned with the fixed stop to a second position to create a discharge opening; means for moving a pile of sheets in one direction perpendicular to the plane of the sheets with one end of the pile being adjacent said movable stop member, said means for moving a pile of sheets including means for regulating the position of the one end of the pile relative to to stop member; means cooperating with the movable stop member in the first position for separating a batch of sheets from said one end of the pile, said means for separating the batch of sheets including a separating member, a movable pile pressing member disposed on each side of the separating member and means for moving said separating member and pressing members with the separating member being moved towards the movable stop member and against the edges of the sheets disposed therebetween to cause a separating and lifting up of a batch of sheets from the pile with the pile pressing members being inserted between the lifted batch and the remaining portion of the pile; and means for moving said batch of sheets in a second direction parallel to the plane of the sheets in the pile through the discharge opening for introduction into a conveyor of the machine, said means for moving the batch including at least one batch pusher arranged on each side of the two movable pile pressing members, and drive means for moving said batch pushers.

4. A device according to claim 3, wherein the means for moving the separating member and the pressing members includes a cradle mounted in said frame for movement along said second direction, said cradle having a pair of levers mounted for pivotable movement from a rest position forming an angle in the range of 15–30 degrees with said second direction, said pair of levers being pivotably connected to the separating member to form a parellelogram linkage with the separating members movable from the rest position to a raised position, said pile pressing members being mounted on said cradle and having a nose piece disposed on a free end for insertion between the batch and pile, and said means for moving the separating member and the pressing members moving said cradle in said second direction.

5. A device according to claim 4, wherein the cradle includes a plurality of rollers being received in tracks on said frame to enable movement of the cradle in said frame, said cradle being connected by a hydraulic piston to said frame for moving said cradle in said frame and each of the pile pressing members being mounted for rotation about a pivot point on the cradle with said rotation being controlled by each of the pressing members having a cam follower in contact with a linear cam secured on the frame.

6. A device according to claim 3, wherein the drive means for moving the batch pushers includes a carriage slideable along a track in the frame, said carriage having means for supporting the batch pusher, and being connected to a drive chain.

7. A device according to claim 6, wherein each of the batch pushers are pivotably mounted on the carriage and has safety means to prevent jamming while handling badly shaped sheets, said safety means including a roller disposed on the batch pusher adjacent the lower end thereof.

8. A device according to claim 3, wherein said frame includes a sub-frame moveable mounted in said frame, said subframe mounting the batch pushers and the means for separating a batch of sheets from the pile, said means for moving the stop member being a piston connected to said sub-frame so that actuation of said piston moves the movable stop from a stop position to a position creating an opening for the device.

9. A device according to claim 3, wherein said separating member is provided with a grooved surface for engaging the edges of the sheets forming said batch.

10. A device according to claim 3, which includes means disposed on the frame for sensing misaligned sheets adjacent the one end of said pile.

* * * * *